US007262566B2

(12) United States Patent
Pirozhenko et al.

(10) Patent No.: US 7,262,566 B2
(45) Date of Patent: Aug. 28, 2007

(54) STANDING-WAVE ELECTRON LINEAR ACCELERATOR

(75) Inventors: Vitaly M. Pirozhenko, Moscow (RU); Gary F. Bowser, Auburn, IN (US); Vladimir M. Belugin, Moscow (RU); Nikolay E. Rozanov, Moscow (RU)

(73) Assignee: ScanTech Holdings, LLC, Atlanta, GA (US)

( * ) Notice: Subject to any disclaimer, the term of this patent is extended or adjusted under 35 U.S.C. 154(b) by 3 days.

(21) Appl. No.: 10/531,126

(22) PCT Filed: Oct. 14, 2003

(86) PCT No.: PCT/US03/32447

§ 371 (c)(1),
(2), (4) Date: Apr. 11, 2005

(87) PCT Pub. No.: WO2004/033613

PCT Pub. Date: Apr. 22, 2004

(65) Prior Publication Data

US 2006/0011825 A1 Jan. 19, 2006

Related U.S. Application Data

(60) Provisional application No. 60/418,198, filed on Oct. 11, 2002.

(51) Int. Cl.
*H05H 9/00* (2006.01)

(52) U.S. Cl. ..... 315/505; 315/501; 315/507; 250/396 R

(58) Field of Classification Search ..... 315/500–507, 315/4, 5.41, 5.42; 250/251, 423, 492, 287, 250/290, 292, 396 R, 423 R
See application file for complete search history.

(56) References Cited

U.S. PATENT DOCUMENTS 4,812,774 A * 3/1989 Tsumaki et al. ..... 315/501
5,001,438 A * 3/1991 Miyata et al. ..... 315/503
5,014,014 A * 5/1991 Swenson ..... 315/505
5,376,893 A * 12/1994 Etievant et al. ..... 315/501
5,572,035 A * 11/1996 Franzen ..... 250/396 R
5,825,140 A * 10/1998 Fujisawa ..... 315/505
6,366,021 B1 * 4/2002 Meddaugh et al. ..... 315/5.41
6,448,722 B1 * 9/2002 Yu et al. ..... 315/505

(Continued)

*Primary Examiner*—Trinh Dinh
*Assistant Examiner*—Tung Le
(74) *Attorney, Agent, or Firm*—Coursey IP Law, P.C.; R. Steven Coursey

(57) ABSTRACT

A particle accelerator system, including apparatuses and methods, for producing a beam of bunched charged particles at high intensities and with minimal energy dispersion comprises a bunching section having a plurality of bunching cavities, an accelerating section having a plurality of accelerating and coupling cavities, and an electromagnetic drive subsystem having a single radio-frequency (RF) generator coupled to the accelerating section at a single location. The accelerating and bunching sections are directly coupled and share a common wall, which may have a resonant coupling cavity therein, such that charged particles bunch in the bunching section and travel through the common wall into the accelerating section where they are accelerated and exit the particle accelerator system as a beam of bunched charged particles. Preferably, a phase shift of one hundred-eighty degrees (180°) (or it radians) is created between the electric fields of successive bunching cavities in the bunching section.

43 Claims, 4 Drawing Sheets

U.S. PATENT DOCUMENTS

2001/0030284 A1* 10/2001 Dresch et al. ..... 250/287
2003/0141448 A1* 7/2003 Symons ..... 250/290
2004/0212331 A1* 10/2004 Swenson et al. ..... 315/506

* cited by examiner

STANDING-WAVE ELECTRON LINEAR ACCELERATOR

CROSS REFERENCE TO RELATED APPLICATION

This application claims the benefit of priority to U.S. provisional application Ser. No. 60/418,198, which is entitled "Electron Standing-Wave Linear Accelerator" and was filed on Oct. 11, 2002.

FIELD OF THE INVENTION

The invention relates, generally, to the field of particle acceleration and, more specifically, to standing-wave linear accelerators having high-intensity electron beams.

BACKGROUND OF THE INVENTION

Particle accelerators produce high-speed, high-energy beams of particles that are utilized in a variety of applications, including radiation therapy, defense technology, imaging, and materials testing. A form of such particle accelerators, electron linear accelerators, are utilized for the sterilization of medical devices and food irradiation.

Traditionally, traveling wave accelerators have been used to achieve the goals of particle acceleration. Unfortunately, traveling wave accelerators have several disadvantages. First, the efficiency of a traveling wave accelerator is low, as the resulting particle beam contains particles that are not tightly bunched together. Second, the operating parameters of the traveling wave accelerators are fixed and there is little range for adjustment. Third, traditional traveling wave accelerators are not capable of producing particle beams at high intensities.

Some inventors have attempted to address these shortcomings by developing standing-wave linear accelerators. Generally, such standing-wave linear accelerators comprise an accelerating resonator, a radio-frequency generator that creates an accelerating field in the accelerating resonator, a solenoid that focuses the beam of particles, a vacuum pump, a power supply, and a control apparatus. The accelerating resonator commonly includes a biperiodic structure of accelerating cavities coupled to coupling cavities that operates in a $\pi/2$-mode. However, this structure alone is inefficient for capturing a large number of particles to bunch and form into a beam. Thus, some inventors have attempted to bunch the particles prior to accelerating the particles.

For example, some inventors have attempted to use designs incorporating a klystron-type buncher. In such a design, the klystron-type buncher and the accelerating resonator are coupled together via a drift space. Particles are bunched together in the klystron-type buncher and then drift through the drift space into the accelerating section for acceleration. Unfortunately, the presence of the drift space creates several disadvantages. First, as particles drift through the drift space, they begin to disperse and do not remain tightly bunched together. Thus, the amount of energy each particle receives in the accelerating section differs significantly which, in turn, creates a large amount of energy dispersion (10%–20%) in the resulting beam of accelerated particles. As a consequence, the overall efficiency of the linear accelerator is decreased. Second, a larger degree of energy dispersion occurs much more at higher intensities than at lower intensities. At very high intensities, the degree of the dispersion is so large that the linear electron accelerator cannot produce any bunches of particles in the resulting beam, which renders the linear accelerator useless at very high intensities. Thus, the large degree of dispersion at high intensities limits the possible applications for the linear accelerator.

Moreover, in systems having a bunching resonator and an accelerating resonator separated by drift space, two radio-frequency generators are typically required. One radio-frequency (RF) generator is required to create an accelerating field in the bunching resonator, and the other radio-frequency generator is required to create an accelerating field in the accelerating resonator. Because each resonator requires its own radio-frequency generator in such a design, the two radio-frequency generators must be in phase with one another for optimal particle bunching and acceleration. Changes in temperature or poor connections, among other factors, can cause the radio-frequency generators to become out of phase, which in turn causes instability in the accelerator system.

Therefore, there exists in the industry a need for standing-wave linear accelerators, including apparatuses and/or methods, which are capable of producing a tightly bunched beam of accelerated particles at high intensities with minimal energy dispersion, which receive electromagnetic power from a single RF generator, and which address these and other related, and unrelated, problems.

SUMMARY OF THE INVENTION

Broadly described, the present invention comprises a particle accelerator system and methods of operating the same. More particularly, the present invention comprises a standing-wave linear electron accelerator system that is configurable to operate at high intensities while maintaining optimum transfer of electromagnetic power from an RF generator to bunching and accelerating sections thereof. The particle accelerator system of the present invention includes a bunching section having a plurality of bunching cavities, an accelerating section (preferably, of a conventional "disc and washer" structure) directly coupled to the bunching section, and a single electromagnetic drive subsystem.

Advantageously, the particle accelerator system includes a bunching section and an accelerating section that are directly coupled via a common wall. A first passageway formed in the common wall shared between the accelerating and bunching sections enables charged particles to travel between the two sections without significant energy dispersion. A second passageway formed in the common wall shared between the accelerating and bunching sections enables electromagnetic power to propagate from the accelerating section into the bunching section.

Also advantageously, the particle accelerator system includes an electromagnetic drive subsystem having a single RF generator coupled to the accelerating section so as to create electric fields in both the accelerating and bunching sections. The RF generator is operable to generate electromagnetic power, in the form of pulses of electromagnetic waves, and to direct the electromagnetic power through the accelerating section and into the bunching section via the second passageway in the shared common wall.

In a first embodiment, the bunching section includes a plurality of bunching cavities operating in $\pi$-mode wherein the phase shift of the electromagnetic waves between adjacent bunching cavities is one hundred-eighty degrees (180°) (or $\pi$ radians). Each bunching cavity has a longitudinal dimension and, preferably, the longitudinal dimension of each successive bunching cavity in the direction of particle acceleration increases in magnitude. Adjacent bunching cavities share a common wall therebetween. A passageway in the shared common wall enables charged particles to travel between successive bunching cavities.

A second embodiment is substantially similar to the first embodiment and includes differences in the configuration of the bunching section. The bunching section includes a plurality of bunching and coupling cavities, wherein a coupling cavity is interposed between two bunching cavities. The cavities operate in a $\pi/2$-mode in which the phase shift of the electromagnetic power, in the form of pulses of electromagnetic waves, between successive cavities is ninety degrees (90°) (or $\pi/2$ radians), and the phase shift between successive bunching cavities is one hundred-eighty degrees (180°) (or $\pi$ radians).

A third embodiment is substantially similar to the second embodiment and includes differences in the configuration of the common wall shared by the accelerating and bunching sections. The common wall shared by the accelerating and bunching sections defines a coupling cavity therein which enables resonant coupling between the accelerating section and the bunching section. The common wall shared by the two sections defines two passageways therein so as to enable charged particles to travel from the bunching section, through the coupling cavity in the common wall, and into the accelerating section and to allow electromagnetic power to propagate from the accelerating section to the bunching section.

In operation, the RF generator of the electromagnetic drive subsystem generates electromagnetic power, in the form of pulses of electromagnetic waves, which are directed into the accelerating section. The electromagnetic power propagates through the accelerating section into the bunching section via the second passageway in the shared common wall. At substantially the same time, charged particles are injected into first bunching cavity of the bunching section, where they begin to bunch. As charged particles travel through the bunching section, they continue to be bunched in successive bunching cavities. The bunched charged particles then travel through the common wall and into the accelerating section, where they are accelerated and exit the particle accelerator system as a beam of tightly bunched charged particles.

Other advantages and benefits of the present invention will become apparent upon reading and understanding the present specification when taken in conjunction with the appended drawings.

DETAILED DESCRIPTION OF THE EMBODIMENTS OF THE PRESENT INVENTION

Figure 1:
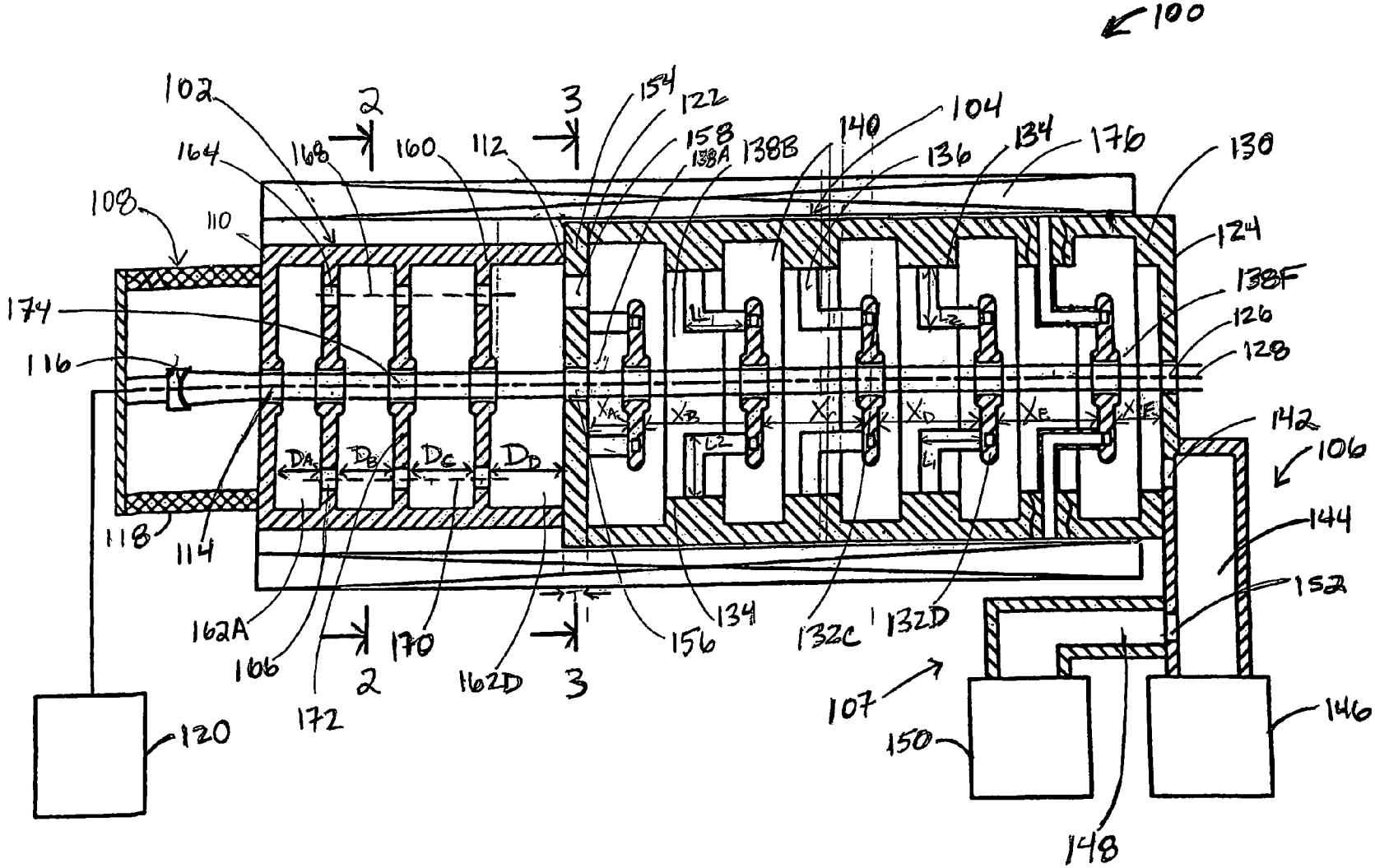
FIG. 1 is pictorial sectional view of a particle accelerator system according to a first embodiment of the present invention with portions of the housings removed in which the bunching section includes a plurality of cavities operating in $\pi$-mode.

Referring now to the drawings in which like numerals represent like elements or steps throughout the several views, FIG. 1 displays a pictorial sectional view of a particle accelerator system 100 according to a first embodiment of the present invention. Particle accelerator system 100 includes a bunching section 102, an accelerating section 104, an electromagnetic drive subsystem 106, a vacuum subsystem 107, and an injector 108. Preferably, the bunching section 102 and the accelerating section 104 comprise standing-wave sections 102, 104 which are operable to accelerate charged particles through the transfer of energy from electromagnetic power provided by the electromagnetic drive subsystem 106.

The bunching section 102 has a first end 110 and a second end 112. The injector 108 is positioned proximate the first end 110 of the bunching section 102 and is connected to an input port 114 of the bunching section 102. Preferably, the injector 108 comprises an electron injector having a cathode 116 with a heater, insulated by a high-voltage insulator 118, and energized by a power supply 120. The injector 108 is operable to generate charged particles, preferably electrons, and to emit them in a pulsed mode of operation as pulses of charged particles, into the bunching,section 102 through input port 114.

Similar to the bunching section 102, the accelerating section 104 has a first end 122 and a second end 124. The accelerating section 104 includes an output port 126 located at the second end 124 of the accelerating section 104. A longitudinal axis 128 of the particle accelerator system 100 extends between, and is defined by, the input port 114 of the bunching section 102 and the output port 126 of the accelerating section 104. As described herein, charged particles are accelerated from the injector 108 towards the output port 126 generally along the longitudinal axis 128. The output port 126 is adapted to direct a beam of charged particles from the accelerating section 104 (and, hence, from the particle accelerator system 100) toward a desired target or other object.

The accelerating section 104 comprises a housing 130 encasing a plurality of conducting washers 132 with discs 134 interposed therebetween. Such a structure is commonly known to one of reasonable skill in the art as a "disc and washer structure". Preferably, the housing 130 has a substantially cylindrical shape. The conducting washers 132 are secured to the housing 130 of the accelerating section 104 by bars 136. Preferably, bars 136 include two or more metal stems securing the conducting washers 132 to the housing 130. Additionally, bars 132 have first portions, "$L_1$", and second portions, "$L_2$". Preferably, the first portions, "$L_1$", of bars 136 are positioned substantially parallel to the longitudinal axis 128 of the particle accelerator system 100 in the node of the electric field created by the electromagnetic drive subsystem 106. Moreover, the bars 136 may include channels extending therethrough for containing a liquid to cool the conducting washers 132. An accelerating cavity 138 of the disc and washer structure is defined as the void present in the axial region between two adjacent conducting washers 132. A coupling cavity 140 is defined as the void present in the peripheral region between two adjacent discs 134. Preferably, the accelerating section 104 includes a plurality of accelerating cavities 138 and coupling cavities 140. In accordance with the first embodiment, the accelerating section 104 includes five accelerating cavities 138, having four whole accelerating cavities 138 and two accelerating half-cavities 138, and five coupling cavities 140 (see FIG. 1). However, it should be understood that while FIG. 1 displays an accelerating section 104 having five accelerating cavities 138 and five coupling cavities 140, the scope of the present invention includes an accelerating section 104 having a different number of cavities 138, 140. The first accelerating cavity 138A (i.e., actually an accelerating half-cavity 138A) is positioned proximate the first end 122 of the accelerating section 104. The last accelerating cavity 138F (i.e., actually an accelerating half-cavity 138F) is positioned proximate the second end 124 of the accelerating section 104. The other four accelerating cavities 138 are positioned therebetween.

The accelerating cavities 138 and coupling cavities 140 are configured such that $\pi/2$-mode is excited in the accelerating section 104. The phase shift between an accelerating cavity 138 and an adjacent coupling cavity 140 is ninety degrees (90°) (or $\pi/2$ radians), so the phase shift between successive accelerating cavities 138 is one hundred-eighty degrees (180°) (or $\pi$ radians). Additionally, accelerating cavity 138 has a longitudinal dimension, "X", which is defined by the relationship $\beta\lambda/2$, where "$\beta$" is the relative velocity of an electron and "$\lambda$" is the wavelength of an electromagnetic wave in free space. The relative velocity of an electron, "$\beta$", is defined as $v/c$, where "$v$" is the velocity of an electron and "$c$" is the velocity of light.

The housing 130 of the accelerating section 104 defines a port 142 which couples the last accelerating cavity 138F to a feeder waveguide 144 of the electromagnetic drive subsystem 106. The feeder waveguide 144 enables electromagnetic power to propagate from an RP generator 146 into the last accelerating cavity 138F and through the other accelerating cavities 138 in a direction generally toward the injector 108 and the first end 122 of the accelerating section 104.

The electromagnetic drive subsystem 106 comprises a radio-frequency (RF) generator 146 and feeder waveguide 144. The RF generator 146 is operable to generate electromagnetic power, in the form of pulses of electromagnetic waves, having a frequency and power level appropriate for operation of the particle accelerator system 100. Preferably, the RF generator 146 includes a klystron which generates electromagnetic waves having a frequency of 2856 MHz. Also preferably, the electromagnetic waves comprise radio-frequency (RF) electromagnetic waves. Alternatively, the RF generator 146 may include a magnetron or other device(s) for generating electromagnetic waves having an appropriate frequency and power level. Notably, the electromagnetic drive subsystem 106 comprises a single RF generator 146 which connects to the bunching section 102 and accelerating section 104 at a single location via a single feeder waveguide 144.

The vacuum subsystem 107 comprises a vacuum pipe 148 and a vacuum pump 150. The feeder waveguide 144 defines an opening 152 therein which couples the vacuum pump 150, via vacuum pipe 148, to the feeder waveguide 144. The vacuum pump 150 is operable to create a vacuum in the feeder waveguide 144 and, hence, in accelerating section 104 by virtue of port 142.

The first end 122 of the accelerating section 104 is coupled to the second end 112 of the bunching section 102 via a common wall 154. The thickness, "T", of the common wall 154 is chosen so that the middle of the electron bunch (i.e., as defined longitudinally between a leading edge and a trailing edge of the electron bunch) is present at the middle of the first accelerating cavity 138A of accelerating section 104 (i.e., as defined by the longitudinal ends, or extent, of the first accelerating cavity 138A) when the time-varying electric field therein is at its maximum. The common wall 154 defines a passageway 156 therethrough so as to enable bunched charged particles to travel between the bunching section 102 and the accelerating section 104.

Figure 3:
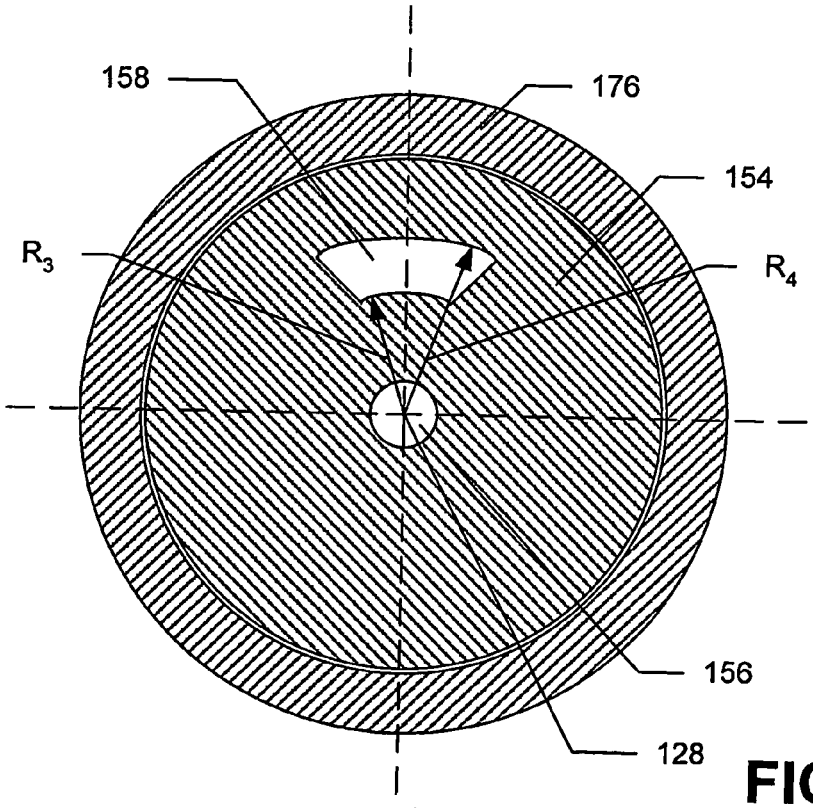
FIG. 3 is a pictorial sectional view of the common wall between the bunching section and the accelerating section of the particle accelerator system of FIG. 1 taken along lines 3–3.

The common wall 154 also defines a passageway 158 therethrough that permits magnetic coupling between the bunching section 102 and the accelerating section 104. As displayed in FIG. 3, passageway 158 has an inner radius, "$R_1$", relative to longitudinal axis 128 and an outer radius, "$R_2$", relative to longitudinal axis 128. Preferably, the measure of outer radius "$R_2$" is greater than the measure of inner radius, "$R_1$". During low-intensity beam acceleration, the required coupling coefficient is produced by having a single passageway 158. However, during high-intensity beam acceleration, the common wall 154 may define more than one passageway 158 extending therethrough so as to produce a greater coupling coefficient. For example, the common wall 154 may define two, three, four, or more passageways 158 to permit sufficient magnetic coupling between the accelerating section 104 and the bunching section 102.

Figure 2:
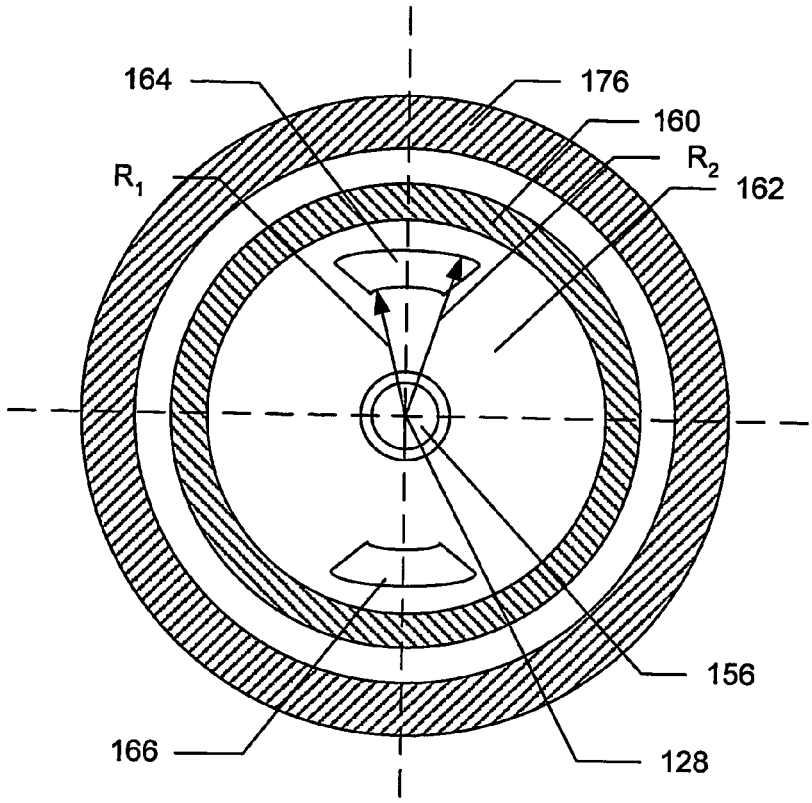
FIG. 2 is a pictorial sectional view of the bunching section of the particle accelerator system of FIG. 1 taken along lines 2–2.

The bunching section 102 includes a housing 160 which defines a plurality of bunching cavities 162 (preferably, four bunching cavities 162) therein arranged in an axial arrangement along longitudinal axis 128. Bunching cavities 162 have, preferably, a substantially cylindrical shape. Preferably, the edges and corners of the bunching cavities 162 are rounded so as to minimize RF losses. Each bunching cavity 162 is RF coupled to the adjacent bunching cavity 162 via two coupling slots 164, 166 which enable electromagnetic power to propagate between adjacent bunching cavities 162. Coupling slots 164, 166 extend in a radial direction from the longitudinal axis 128 as shown in FIG. 2. Coupling slots 164, 166 have an inner radius, "$R_3$" and an outer radius, "$R_4$". Preferably, the measure of outer radius, "$R_4$", is greater than the measure of inner radius, "$R_3$". Also preferably, the coupling slots 164, 166 are diametrically opposed to one another about longitudinal axis 128. Additionally, axes 168, 170 extend through coupling slots 164, 166 and are substantially parallel to longitudinal axis 128.

Common walls 172 are shared by and reside between adjacent bunching cavities 162. Each common wall 172 defines a passageway 174 extending therethrough so that adjacent bunching cavities 162 are connected by respective passageways 174. The passageways 174 are adapted to direct charged particles between adjacent bunching cavities 162.

Additionally, each bunching cavity 162 has a respective longitudinal dimension, "D", measured in the direction of longitudinal axis 128. The longitudinal dimensions, "D", of the bunching cavities 162 are chosen to provide maximum energy and minimum energy spread of the accelerated charged particles during their travel through the bunching cavities 162. Preferably, the longitudinal dimensions, "D", of adjacent bunching cavities 162 differ. Even more preferably, the longitudinal dimension, "D", of each successive bunching cavity 162 in the direction of particle acceleration increases in magnitude. For example, bunching cavities 162A, 162B, 162C, 162D have respective longitudinal dimensions, "$D_A$", "$D_B$", "$D_C$", "$D_D$". Preferably, longitudinal dimension, "$D_D$", is greater than longitudinal dimension "$D_C$", which is greater than longitudinal dimension, "$D_B$", which is greater than longitudinal dimension, "$D_A$".

The bunching cavities 162 are configured such that π-mode is excited in the bunching section 102 or, in other words, the phase shift of the electric fields in successive bunching cavities 162 in the direction of particle acceleration alternates by one hundred-eighty degrees (180°) (or π radians). For example, the second bunching cavity 162B is configured such that the electric field created by the electromagnetic power has a phase shift of one hundred-eighty degrees (180°) (or π radians) relative to the electric field in the first bunching cavity 162A. The amplitudes of the electric fields in each of the bunching cavities 162 vary and are determined, in part, by the longitudinal dimension, "D", of its respective bunching cavity 162. The amplitude of the electric field in the first bunching cavity 162A is preferably less than the amplitude of the injection voltage of charged particles such that all charged particles travel into the second bunching cavity 162B and begin to bunch. The configuration of the successive bunching cavities 162 are also such that the incremental amount of energy each charged particle receives is increased in each successive bunching cavity 162 in the direction of particle acceleration, which in turn decreases the phase extent in the resulting charged particle beam.

A solenoid 176, operable to focus the beam of charged particles along the lengths of the bunching section 102 and accelerating section 104, extends substantially adjacent to the housings 130, 160 of the bunching and accelerating sections 102, 104. The particle accelerator system 100 also comprises a power supply and a control mechanism which are not shown and which should be known to one of reasonable skill in the art.

In operation, the injector 108 generates and emits charged particles (preferably, electrons) into the bunching section 102 (preferably, at a current of 100 A) and, at substantially the same time, the RF generator 146 of the electromagnetic drive subsystem 106 generates electromagnetic power, in the form of pulses of electromagnetic waves (preferably, radio-frequency electromagnetic waves), which are directed into the accelerating section 104 via feeder waveguide 144 and port 142. The electromagnetic power, in the form of the electromagnetic waves, propagates throughout the length of the accelerating section 104, thereby creating accelerating fields in the accelerating cavities 138 of the accelerating section 104 such that a phase shift of one hundred-eighty degrees (180°) (or π radians) is produced between the accelerating fields of successive accelerating cavities 138. The electromagnetic power then propagates into and throughout the bunching section 102 via passageway 158, thereby creating an electric field in each of the bunching cavities 162 of the bunching section 102 so that a phase shift of one hundred-eighty degrees (180°) (or π radians) is produced between the electric fields of adjacent bunching cavities 162. Importantly, by allowing electromagnetic power to propagate from the accelerating section 104 into the bunching section 102, passageway 158 enables the particle accelerator system 100 to operate with only one RF generator 146 or electromagnetic power source.

At substantially the same time, the charged particles emitted into the bunching section 102 by injector 108 travel into the first bunching cavity 162A where they begin to be bunched. The charged particles traveling through the first bunching cavity 162A then pass into the second bunching cavity 162B where the charged particles continue to be bunched and receive an incremental amount of energy imparted from the electromagnetic power. The charged particles continue to receive an incremental amount of energy and continue to be bunched in each successive bunching cavity 162 as they travel through successive bunching cavities 162. As the charged particles travel through the bunching section 102, the solenoid 176 focuses the bunched charged particles into a beam of bunched charged particles and provides transverse stability of the charged particle beam.

Upon reaching the second end 112 of the bunching section 102, the bunched charged particles have a higher energy level and a reduced beam space charge force as compared to their energy level and beam space charge force when initially emitted by injector 108 into bunching section 102. This result occurs at least in part because the force of the beam space charge is inversely proportionate to βγ, where "β" is the relative velocity of an electron and is equal to "v/c" with "v" being the velocity of the charged particle and "c" being the velocity of light and where "γ" equals the ratio of the energy of a bunched charged particle, "E", and the energy of the bunched charged particle at rest, "$E_o$". Thus, the beam of charged particles enters accelerating section 104 in the form of compact bunches of charged particles in which the beam space charge forces are attenuated.

After entering the first end 122 of the accelerating section 104 through passageway 156, the bunched charged particles, in the form of a beam, are accelerated through the accelerating section 104 by the energy of the electromagnetic power (i.e., in the form of pulses of electromagnetic waves) and are transversely focused by the solenoid 176. In the time of transit of the bunched charged particles through the first accelerating cavity 138A, the electric field in the second accelerating cavity 138B becomes an accelerating electric field (as opposed to being a decelerating electric field) and the bunched charged particles then obtain an increment of energy imparted by the accelerating electric field created therein. Preferably, the bunched charged particles receive the maximum increment of energy that can be imparted by the accelerating electric field therein. At this point, the relative spread of energies is minimum and equals approximately $\Delta E/E=\Delta\phi^2/8$, where "Δφ" is phase extent of the bunch. The bunched charged particles then exit the particle accelerator system 100 at output port 126 located at the second end 122 thereof as a tightly bunched beam of accelerated charged particles.

Figure 4:
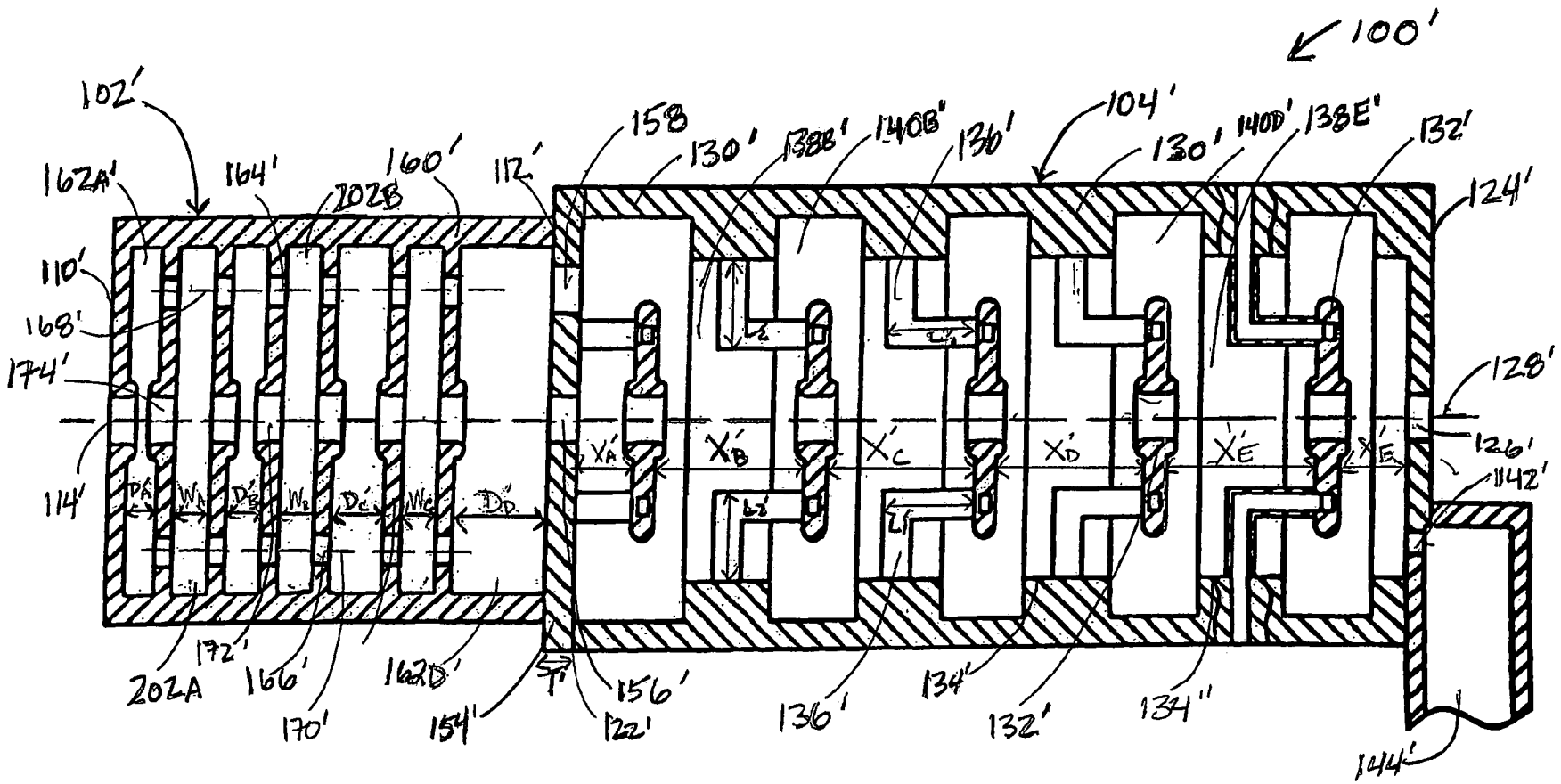
FIG. 4 is a partial pictorial sectional view of a particle accelerator system according to a second embodiment of the present invention in which a bunching section thereof includes a plurality of bunching cavities and a plurality of coupling cavities.

FIG. 4 displays a partial pictorial sectional view of a particle accelerator system 100' with portions of the housings 130', 160' removed and in which the bunching section 102' includes a plurality of bunching cavities 162' operating in π/2-mode in accordance with a second embodiment of the present invention. Notably, the particle accelerator system 100' of the second embodiment is preferable for high-intensity beam acceleration and is substantially similar in structure and operation to the particle accelerator system 100 of the first embodiment, but with certain exceptions as described herein.

The bunching section 102' includes a plurality of bunching cavities 162' which are substantially similar to bunching cavities 162 of the particle accelerator system 100 of the first embodiment and also includes a plurality of coupling cavities 202 which are operable to produce resonant coupling between the bunching cavities 162'. Bunching cavities 162' and coupling cavities 202 are arranged coaxially such that a coupling cavity 202 is interposed between each successive pair of bunching cavities 162'. Preferably, bunching cavity 162A' is positioned proximate the first end 110' of the bunching section 102', and bunching cavity 162D' is positioned proximate the second end 112' of the bunching section 102'.

The bunching cavities 162' and coupling cavities 202 are, preferably, adapted so that the bunching section 102' operates in π/2-mode. As a consequence, the phase shift of the electromagnetic waves and the corresponding electric fields between each bunching cavity 162' and each adjacent coupling cavity 202 is ninety degrees (90°) (or π/2 radians). As in the first embodiment, the phase shift of the electromagnetic waves generated by the RF generator 146' and the corresponding electric fields created in successive bunching cavities 162' is one hundred-eighty degrees (180°) (or π radians) between each successive pair of bunching cavities 162'.

Each coupling cavity 202 has, preferably, a substantially cylindrical shape with a longitudinal dimension, "W". Unlike the longitudinal dimensions, "D'", of successive bunching cavities 162' which increase in the direction of particle acceleration, the longitudinal dimensions, "W", of the coupling cavities 202, preferably, are equal for all coupling cavities 202. Coupling cavities 202 are configured such that the electric fields created by the electromagnetic power, in form of pulses of electromagnetic waves from the RF generator 146', are preferably small in comparison to the electric fields created in bunching cavities 162'.

A desired electromagnetic field distribution in bunching cavities 162' may be obtained by selecting appropriate coefficients of coupling, "k". For example, the relationship between the amplitude of electric field, "$E_1$", created in bunching cavity 162A' and the amplitude of the electric field, "$E_2$", created in bunching cavity 162B' is defined as $E_1/E_2=k_2/k_1$, where "$k_1$" is the coefficient of coupling between bunching cavity 162A' and coupling cavity 202A and "$k_2$" is the coefficient of coupling between bunching cavity 162B' and coupling cavity 202A.

It should be noted that because the amplitudes of the electric fields created in successive bunching cavities 162' rise slower than the amplitudes of the electric fields created in successive bunching cavities 162 of the first embodiment, a longer bunching section 102' having additional bunching cavities 162' and coupling cavities 202 may be used in the particle accelerator system 100' of the second embodiment.

In operation, the particle accelerator system 100' operates in a manner substantially similar manner to that of the particle accelerator system 100 described herein, but with certain exceptions. Electromagnetic power, in the form of pulses of electromagnetic waves, propagates through the accelerating section 104' and into the bunching section 102' after entering the accelerating section 104' via port 142'. As the electromagnetic power propagates through the last bunching cavity 162D' and into the last coupling cavity 202C, a phase shift of ninety degrees (90°) (or π/2 radians) is created between the electric fields of cavities 162D' and 202C. Additionally, a phase shift of one hundred-eighty degrees (180°) (or π radians) is created between the electric fields of successive bunching cavities 162'.

At substantially the same time, the charged particles emitted into the bunching section 102' by injector 108' travel into the first bunching cavity 162A' where they begin to be bunched. The charged particles traveling through the first bunching cavity 162A' then pass through the first coupling cavity 202A and into the second bunching cavity 162B' where the charged particles continue to be bunched and receive an increment of energy imparted from the electromagnetic power. The charged particles continue to receive an increment of energy and continue to be bunched in each successive bunching cavity 162' as they travel through successive bunching cavities 162'. As the charged particles travel through the bunching section 102', the solenoid 176' focuses the bunched charged particles into a beam of bunched charged particles and provides transverse stability of the charged particle beam.

Figure 5:
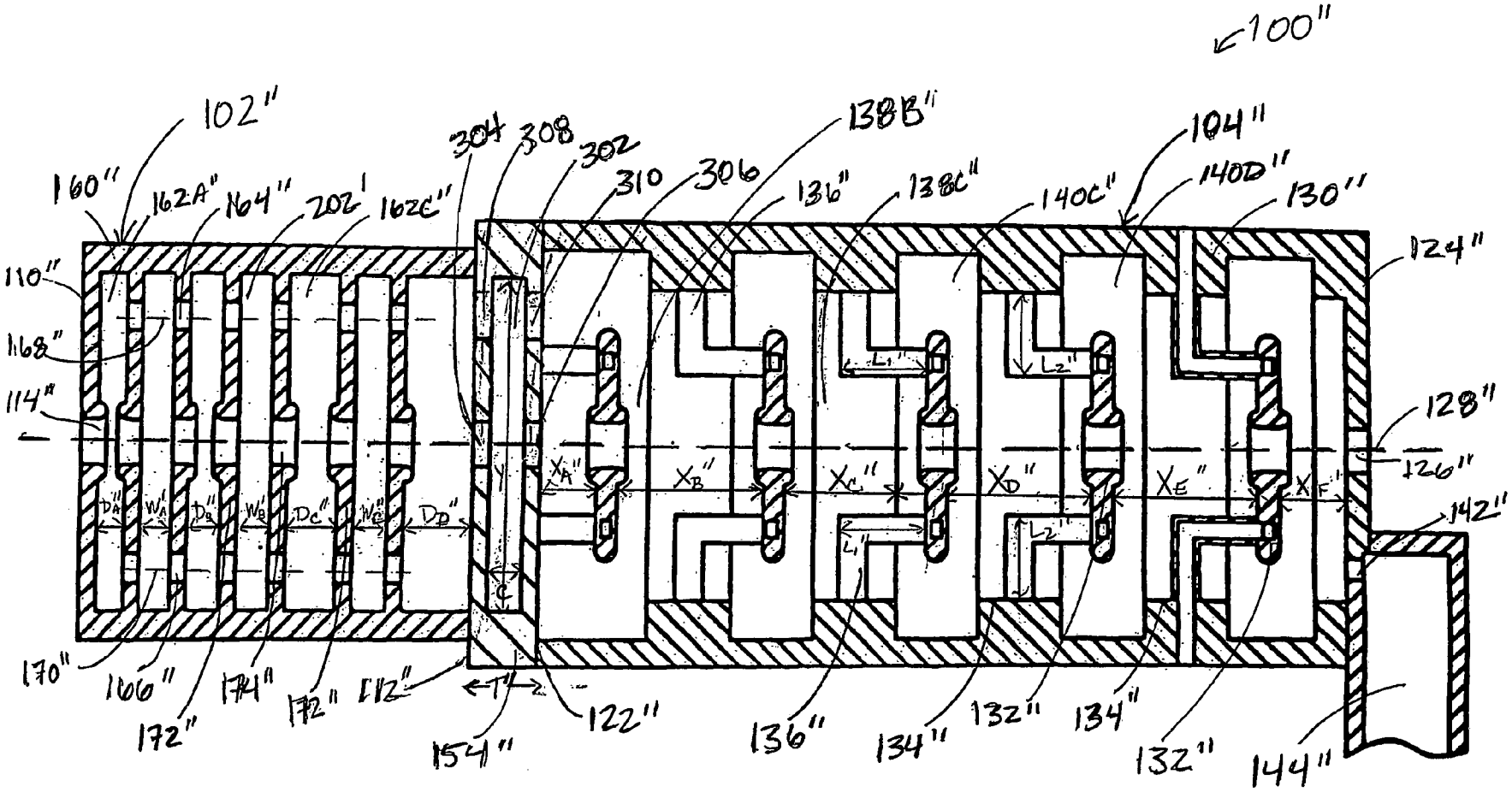
FIG. 5 is a partial pictorial sectional view of a particle accelerator system according to a third embodiment of the present invention in which the bunching section, which includes a plurality of cavities operating in $\pi/2$-mode, and the accelerating section are separated by a common wall having a resonant coupling cavity therein.

FIG. 5 displays a partial pictorial sectional view of a particle accelerator system 100" according to a third embodiment of the present invention with portions of the housings 130", 160" removed. The particle accelerator system 100" of the third embodiment is substantially similar to that of the second embodiment, but with certain exceptions as described herein. The particle accelerator system 100" is preferable for obtaining a more stable relation of the electric field amplitudes in the bunching section 102" and accelerating section 104".

Common wall 154" between bunching section 102" and accelerating section 104" defines a coupling cavity 302 therein. Coupling cavity 302 has a longitudinal dimension, "C", and a diameter, "Y". The longitudinal dimension, "C", and the diameter, "Y", of the coupling cavity 302 are selected such that the coupling cavity 302 is resonant at the operating frequency of the particle accelerator system 100" and acts like a resonant coupling cavity. The common wall 154" also defines a first passageway 304 therethrough such that bunching section 102" couples to coupling cavity 302 and defines a second passageway 306 therethrough such that the accelerating section 104" couples to coupling cavity 302. The first and second passageways 304, 306 enable bunched charged particles to travel from the bunching section 102", through coupling cavity 302, and into the accelerating section 104. Moreover, the common wall 154" defines a third passageway 308 and a fourth passageway 310 therethrough so as to enable electromagnetic power, in the form of pulses of electromagnetic waves from the RF generator 146", to propagate through the accelerating section 104" and into the bunching section 102". In operation, the particle accelerator system 100" operates in a manner substantially similar manner to that of the particle accelerator system 100' described herein.

Whereas the present invention has been described in detail above with respect to exemplary embodiments thereof, it is understood that variations and modifications can be effected within the spirit and scope of the invention, as described herein before and as defined in the appended claims. The corresponding structures, materials, acts, and equivalents of all means-plus-function elements, if any, in the claims below are intended to include any structure, material, or acts for performing the functions in combination with other claimed elements as specifically claimed.

What is claimed is:

1. A particle accelerator system, comprising:

an injector for emitting charged particles;

a bunching section having a plurality of bunching cavities therein, said bunching cavities being operable to receive charged particles from said injector and to bunch said received charged particles; and, an accelerating section directly coupled to said bunching section, said accelerating section being operable to receive bunched charged particles from said bunching section and to accelerate said bunched charged particles, said accelerating section defining a port for receiving radio-frequency power;

wherein said port comprises a sole and only port of both of said accelerating section and said bunching section for receiving radio-frequency power.

2. The particle accelerator system of claim 1, wherein said bunching section and said accelerating section are coupled for the communication of radio-frequency power from said accelerating section into said bunching section.

3. The particle accelerator system of claim 1, wherein said bunching section and said accelerating section are connected by a passageway adapted to allow radio-frequency power to propagate from said accelerating section into said bunching section, and wherein said particle accelerator system has a longitudinal axis and said passageway is radially offset relative to said longitudinal axis.

4. The particle accelerator system of claim 1, wherein said particle accelerator system further comprises a radio-frequency power source connected to said port, said radio-frequency power source being adapted to supply radio-frequency power to said accelerating section and to said bunching section through said port.

5. The particle accelerator system of claim 4, wherein said accelerating section has an end at which a beam of accelerated charged particles is output, and wherein said accelerating section defines said port proximate said end.

6. The particle accelerator system of claim 1, wherein said bunching section and said accelerating section are adapted receive radio-frequency power from a single radio-frequency power source through said port.

7. The particle accelerator system of claim 1, wherein said particle accelerator system further comprises a common wall extending between said bunching section and said accelerating section, said common wall defining a passageway extending therethrough between said bunching section and said accelerating section, said passageway being adapted to enable electromagnetic power to propagate from said accelerating section into said bunching section.

8. The particle accelerator system of claim 7, wherein said passageway comprises a first passageway and said common wall defines a second passageway extending therethrough between said bunching section and said accelerating section, said second passageway being adapted to enable bunched charged particles from said bunching section to travel into said accelerating section.

9. The particle accelerator system of claim 1, wherein said particle accelerator system further comprises a radio-frequency power source adapted to produce radio-frequency power for delivery to both of said accelerating section and said bunching section, and wherein said accelerating section is communicatively interposed between said bunching section and said radio-frequency power source for the communication of said radio-frequency power from said radio-frequency power source to said bunching section through said accelerating section.

10. The particle accelerator system. of claim 1, wherein each of said bunching cavities of said plurality of bunching cavities has a dimension extending in the primary direction of travel of said charged particles through said bunching section, and wherein said dimension of a first bunching cavity of said plurality of bunching cavities is greater than said dimension of a second bunching cavity of said plurality of bunching cavities, said second bunching cavity being positioned relative to said first bunching cavity in the primary direction of travel of said charged particles through said bunching section.

11. The particle accelerator system of claim 1, wherein said bunching section has a first end and a second end, wherein said bunching cavities of said bunching section are axially aligned along an axis in a direction extending from said first end toward said second end, wherein each said bunching cavity has a dimension extending in said direction, and wherein said dimension of each said bunching cavity of said plurality of bunching cavities increases in magnitude for each said bunching cavity positioned successively in said direction.

12. A particle accelerator system, comprising:

an injector for emitting charged particles;

a bunching section operable to receive charged particles from said injector and to bunch said received charged particles;

an accelerating section operable to receive bunched charged particles from said bunching section and to accelerate said bunched charged particles; and a resonant coupling cavity interposed between said bunching section and said accelerating section.

13. The particle accelerator system of claim 12, wherein said particle accelerator system further comprises a wall extending between said bunching section and said accelerating section, and wherein said wall defines said resonant coupling cavity therein.

14. The particle accelerator system of claim 13, wherein said wall further defines a first passageway extending between said bunching section and said resonant coupling cavity, and wherein said wall further defines a second passageway extending between said accelerating section and said resonant coupling cavity.

15. The particle accelerator system of claim 14, wherein said first passageway, said second passageway, and said resonant coupling cavity are adapted to enable radio-frequency power to propagate from said accelerating section to said bunching section.

16. The particle accelerator system of claim 14, wherein said first passageway, said second passageway, and said resonant coupling cavity are adapted to enable charged particles to travel from said bunching section to said accelerating section.

17. The particle accelerator system of claim 12, wherein said resonant coupling cavity is adapted to communicate radio-frequency power from said accelerating section into said bunching section.

18. The particle accelerator system of claim 12, wherein said coupling cavity comprises a resonant coupling cavity.

19. The particle accelerator system of claim 12, wherein said accelerating section has a port, and wherein said particle accelerator system further comprises a radio-frequency power source connected to said port, said radio-frequency power source being adapted to supply radio-frequency power to said accelerating section and to said bunching section through said port.

20. The particle accelerator system of claim 12, wherein said bunching section and said accelerating section are adapted receive radio-frequency power from a single radio-frequency power source.

21. The particle accelerator system of claim 12, wherein said particle accelerator system further comprises a radio-frequency power source adapted to produce radio-frequency power for delivery to both of said accelerating section and said bunching section, and wherein said accelerating section is communicatively interposed between said bunching section and said radio-frequency power source for the communication of said radio-frequency power from said radio-frequency power source to said bunching section through said accelerating section.

22. The particle accelerator system of claim 12, wherein said bunching section comprises a plurality of bunching cavities therein and has a first end and a second end, wherein said bunching cavities of said bunching section are axially aligned along an axis in a direction extending from said first end toward said second end, wherein each said bunching cavity has a dimension extending in said direction, and wherein said dimension of each said bunching cavity of said plurality of bunching cavities increases in magnitude for each said bunching cavity positioned successively in said direction.

23. The particle accelerator system of claim 22, wherein said bunching section further comprises a plurality of coupling cavities therein, and wherein at least one of said coupling cavities of said plurality of coupling cavities is interposed between successive bunching cavities of said plurality of bunching cavities.

24. The particle accelerator system of claim 23, wherein said particle accelerator system defines a passageway extending between a bunching cavity of said plurality of bunching cavities and a coupling cavity of said plurality of coupling cavities.

25. The particle accelerator system of claim 24, wherein said passageway is adapted to allow radio-frequency power to propagate between said bunching cavity and said coupling cavity.

26. The particle accelerator system of claim 12, wherein said bunching section comprises a plurality of bunching cavities therein and a plurality of coupling cavities therein, and wherein at least one of said coupling cavities of said plurality of coupling cavities is interposed between successive bunching cavities of said plurality of bunching cavities.

27. The particle accelerator system of claim 12, wherein said bunching section comprises a plurality of bunching cavities therein and a plurality of coupling cavities therein, and wherein at least one of said bunching cavities of said plurality of bunching cavities is interposed between successive coupling cavities of said plurality of coupling cavities.

28. The particle accelerator system of claim 12, wherein said bunching section comprises a plurality of bunching cavities therein and at least one coupling cavity therein, and wherein said at least one coupling cavity is interposed between a first bunching cavity of said plurality of bunching cavities and a second bunching cavity of said plurality of bunching cavities.

29. The particle accelerator system of claim 28, wherein said particle accelerator system defines a passageway extending between said at least one coupling cavity and said first bunching cavity of said plurality of bunching cavities.

30. The particle accelerator system of claim 29, wherein said passageway is adapted to enable radio-frequency power to propagate between said at least one coupling cavity and said first bunching cavity of said plurality of bunching cavities.

31. The particle accelerator system of claim 29, wherein said passageway is adapted to enable charged particles to travel between said at least one coupling cavity and said first bunching cavity of said plurality of bunching cavities.

32. A particle accelerator system, comprising:

an injector for emitting charged particles;

a bunching section having a first end and a second end and including a plurality of bunching cavities and at least one coupling cavity therein, said bunching cavities being axially aligned along an axis in a direction extending from said first end toward said second end, wherein each said bunching cavity has a dimension extending in said direction and said dimension of each said bunching cavity of said plurality of bunching cavities increases in magnitude for each said bunching cavity positioned successively in said direction, and wherein said bunching cavities are operable to receive charged particles from said injector and to bunch said received charged particles; and an accelerating section directly coupled to said bunching section, said accelerating section being operable to receive bunched charged particles from said bunching section and to accelerate said bunched charged particles.

33. The particle accelerator system of claim 32, wherein said bunching section and said accelerating section are coupled for the communication of radio-frequency power from said accelerating section into said bunching section.

34. The particle accelerator system of claim 32, wherein said bunching section and said accelerating section are connected by a passageway adapted to allow radio-frequency power to propagate from said accelerating section into said bunching section.

35. The particle accelerator system of claim 32, wherein said accelerating section has a port, and wherein said particle accelerator system further comprises a radio-frequency power source connected to said port, said radio-frequency power source being adapted to supply radio-frequency power to said accelerating section and to said bunching section through said port.

36. The particle accelerator system of claim 32, wherein said bunching section and said accelerating section are adapted receive radio-frequency power from a single port connected to a single radio-frequency power source.

37. The particle accelerator system of claim 32, wherein said bunching section and said accelerating section are connected by a passageway adapted to allow bunched charged particles to propagate from said bunching section into said accelerating section.

38. The particle accelerator system of claim 32, wherein said particle accelerator system further comprises a radio-frequency power source adapted to produce radio-frequency power for delivery to both of said accelerating section and said bunching section, and wherein said accelerating section is communicatively interposed between said bunching section and said radio-frequency power source for the communication of said radio-frequency power from said radio-frequency power source to said bunching section through said accelerating section.

39. The particle accelerator system of claim 32, wherein said bunching section has a first end and a second end, wherein said bunching cavities of said bunching section are axially aligned along an axis in a direction extending from said first end toward said second end, wherein each said bunching cavity has a dimension extending in said direction, and wherein said dimension of each said bunching cavity of said plurality of bunching cavities increases in magnitude for each said bunching cavity positioned successively in said direction.

40. The particle accelerator system of claim 32, wherein said at least one coupling cavity is interposed between a first bunching cavity of said plurality of bunching cavities and a second bunching cavity of said plurality of bunching cavities.

41. The particle accelerator system of claim 40, wherein said particle accelerator system defines a passageway extending between said at least one coupling cavity and said first bunching cavity of said plurality of bunching cavities.

42. The particle accelerator system of claim 41, wherein said passageway is adapted to enable radio-frequency power to propagate between said at least one coupling cavity and said first bunching cavity of said plurality of bunching cavities.

43. The particle accelerator system of claim 41, wherein said passageway is adapted to enable charged particles to travel between said at least one coupling cavity and said first bunching cavity of said plurality of bunching cavities.

* * * * *